US009211000B1

(12) United States Patent
Storkel et al.

(10) Patent No.: US 9,211,000 B1
(45) Date of Patent: Dec. 15, 2015

(54) WALKER ATTACHABLE TRAY

(71) Applicants: Daniel B. Storkel, New Berlin, WI (US); Dean J. Storkel, New Berlin, WI (US); Craig A. Zaune, Milwaukee, WI (US)

(72) Inventors: Daniel B. Storkel, New Berlin, WI (US); Dean J. Storkel, New Berlin, WI (US); Craig A. Zaune, Milwaukee, WI (US)

( * ) Notice: Subject to any disclaimer, the term of this patent is extended or adjusted under 35 U.S.C. 154(b) by 3 days.

(21) Appl. No.: 14/445,858

(22) Filed: Jul. 29, 2014

(51) Int. Cl.
*A47B 37/00* (2006.01)
*A47B 23/00* (2006.01)
*A61H 3/00* (2006.01)

(52) U.S. Cl.
CPC ..... *A47B 23/001* (2013.01); *A61H 3/00* (2013.01); *A61H 2003/004* (2013.01)

(58) Field of Classification Search
CPC ..... A61H 2003/004; A61H 2003/002; A61H 3/00; A45B 2200/1063; A47B 23/001
USPC ..... 108/50.16, 28; 135/66, 67, 85
See application file for complete search history.

(56) References Cited

U.S. PATENT DOCUMENTS 4,074,683 A * 2/1978 Di Chiara ..... A61H 3/00 135/67
5,170,810 A * 12/1992 Chapin ..... A61H 3/00 108/47
5,217,032 A * 6/1993 Jobst ..... A61H 3/00 135/67
5,273,063 A * 12/1993 Farr ..... A61H 3/00 135/66
5,531,238 A * 7/1996 Azzarelli ..... A61H 3/00 135/66
5,642,748 A * 7/1997 Obitts ..... A61H 3/00 135/66
5,716,063 A * 2/1998 Doyle ..... A61H 3/04 135/67
5,816,593 A * 10/1998 Che ..... A61H 3/04 280/641
5,865,065 A * 2/1999 Chiu ..... B62L 3/02 74/489
5,887,887 A * 3/1999 Keuning ..... A61H 3/04 280/47.38
6,296,263 B1 * 10/2001 Schultz ..... A61H 3/04 135/67
6,340,168 B1 * 1/2002 Woleen ..... A61H 3/04 135/67
2002/0179131 A1 * 12/2002 Johnson ..... A61H 3/00 135/66
2004/0040589 A1 * 3/2004 Ennals ..... A61H 3/00 135/67
2005/0236025 A1 * 10/2005 Gale ..... A45B 7/00 135/74
2008/0007020 A1 * 1/2008 Holman ..... A61H 3/00 280/87.051
2008/0141911 A1 * 6/2008 McKenna ..... A47B 37/00 108/50.16
2008/0185797 A1 8/2008 Bohn
2013/0119626 A1 * 5/2013 Haut ..... B62B 9/245 280/47.38
2013/0306119 A1 * 11/2013 Catchings ..... A61G 5/10 135/66

FOREIGN PATENT DOCUMENTS

WO WO 2004014198 A2 * 2/2004 ..... B60N 3/103

* cited by examiner

*Primary Examiner* — Hanh V Tran
(74) *Attorney, Agent, or Firm* — Donald J. Ersler

(57) ABSTRACT

A walker attachable tray preferably includes a tray base, a mounting bracket and a pair of support rings. The tray base includes a raised peripheral rim. The mounting bracket includes a base member, at least one mounting flange and a cross bar hook. The mounting bracket is attached to a bottom of the tray base. A pin opening is formed in each end of the base member. The at least one mounting flange preferably extends from an edge of the base member and upward. The cross bar hook preferably extends from an opposing edge of the base member and downward. Each support ring includes a ring portion, a retention pin and a set screw. The ring portion includes an inner diameter. The retention pin extends upward from the ring portion. The pair of support rings are retained on a pair of handles of a four wheel walker.

12 Claims, 6 Drawing Sheets

WALKER ATTACHABLE TRAY

BACKGROUND OF THE INVENTION

1. Field of the Invention

The present invention relates generally to mobility devices and more specifically to a walker attachable tray, which may be removably attached to most four wheel walkers.

2. Discussion of the Prior Art

Patent application no. 2008/0185797 to Bohn discloses an armrest rolling walker with removable utility tray. However, Bohn does not teach or suggest a walker attachable tray, which may be removably attached to most four wheel walkers.

Accordingly, there is a clearly felt need in the art for a walker attachable tray, which may be removably attached to most four wheel walkers without installing a specialized structure.

SUMMARY OF THE INVENTION

The present invention provides a walker attachable tray, which may be removably attached to most four wheel walkers. The walker attachable tray preferably includes a tray base, a mounting bracket and a pair of support rings. The tray base may be any suitable plastic or metal tray with a raised peripheral rim. A cup holder opening may be formed through the tray base to receive a cup holder. The mounting bracket includes a base member, at least one mounting flange and a cross bar hook. The mounting bracket is attached to a bottom of the tray base adjacent one lengthwise edge thereof. A pin opening is formed in each end of the base member. The at least one mounting flange extends from an edge of the base member and upward. The cross bar hook preferably extends from an opposing edge of the base member and downward. Each support ring includes a ring portion, a retention pin and a set screw. The ring portion includes an inner diameter. The retention pin extends upward from the ring portion. An axis of the set screw is perpendicular to an axis of an inner diameter of the ring portion.

In use, the walker attachable tray is preferably secured to a four wheel walker in the following manner. A pair of handles are removed from the four wheel walker. The pair of support rings are slipped on to the pair of handles and the pair of handles are re-inserted into the four wheel walker. The retention pins are positioned, such that they face inward toward each other. The pair of set screws are tightened on the pair of handles. The cross bar hook is hooked around a front cross member of the four wheel walker tray and the walker attachable tray is lowered such that the pair of pin openings are slipped over the pair of retention pins. An opposing lengthwise edge of the walker attachable tray is lower and supported by a back rest cross bar of the four wheel walker.

Accordingly, it is an object of the present invention to provide a walker attachable tray, which may be attached to most four wheel walkers without installing a specialized structure.

These and additional objects, advantages, features and benefits of the present invention will become apparent from the following specification.

DETAILED DESCRIPTION OF THE PREFERRED EMBODIMENTS

Figure 1:
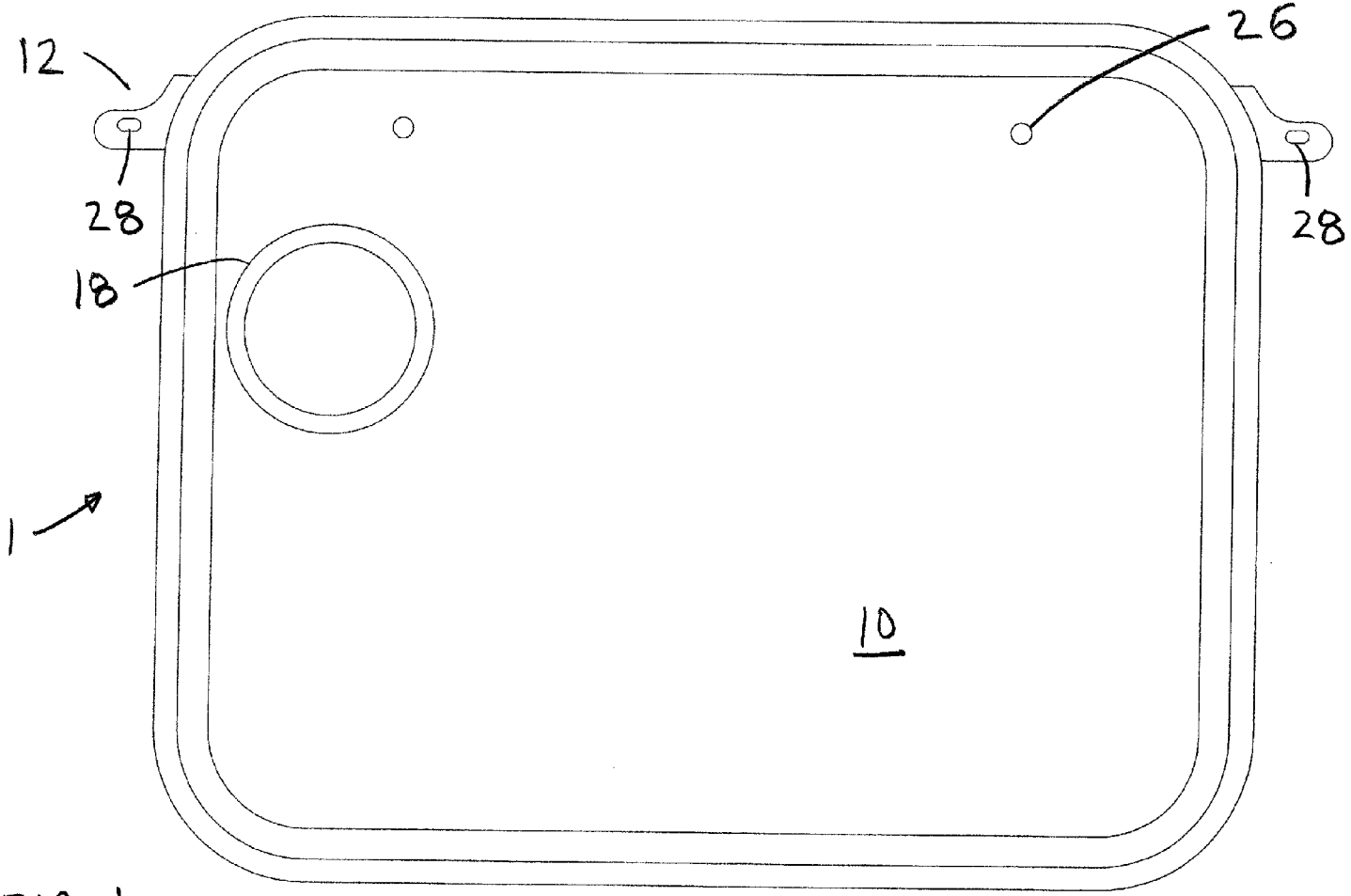
FIG. 1 is a top view of a walker attachable tray in accordance with the present invention.
Figure 2:
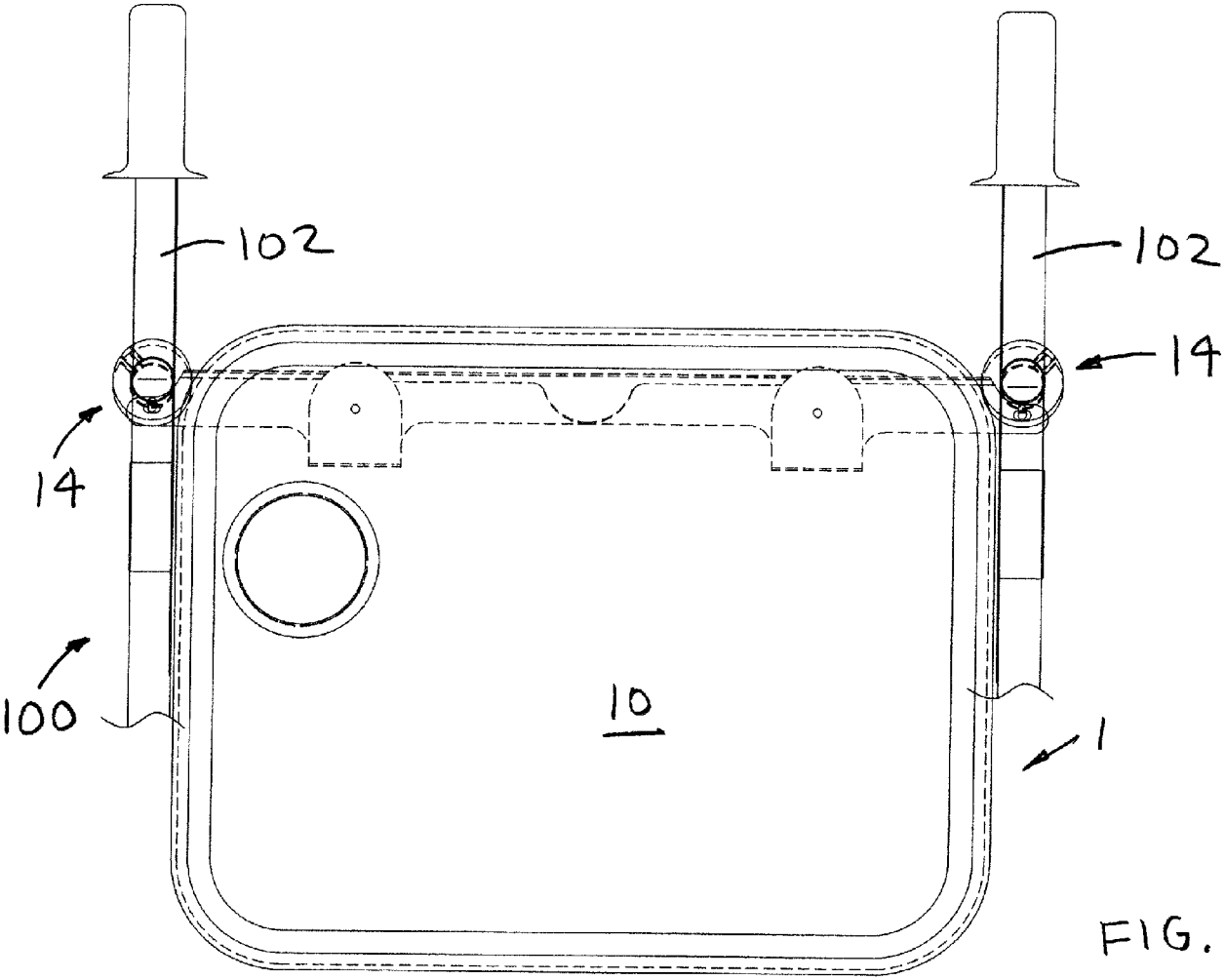
FIG. 2 is a top view of walker attachable tray secured to a four wheel walker in accordance with the present invention.
Figure 3:
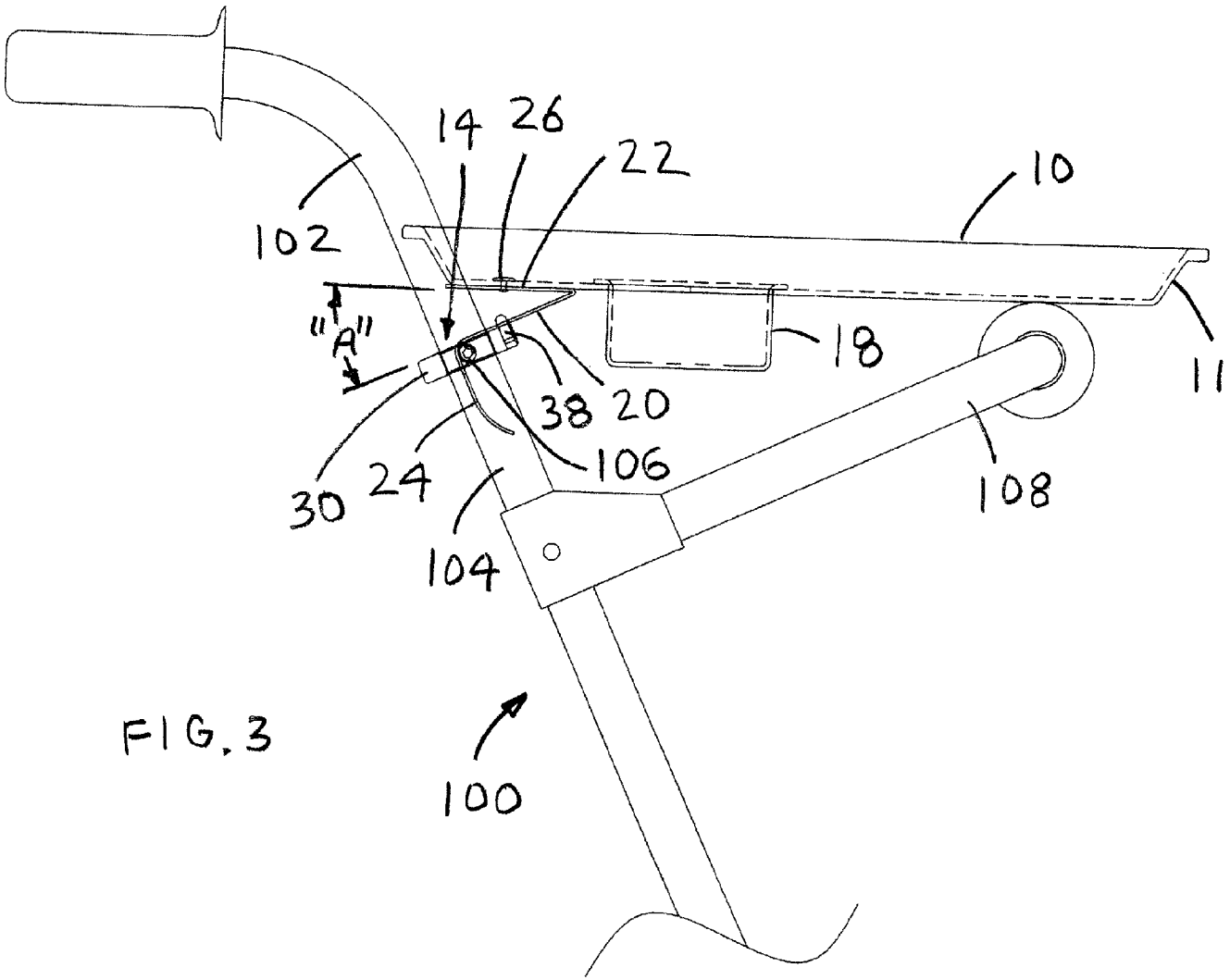
FIG. 3 is an enlarged side view of walker attachable tray secured to a four wheel walker in accordance with the present invention.
Figure 4:
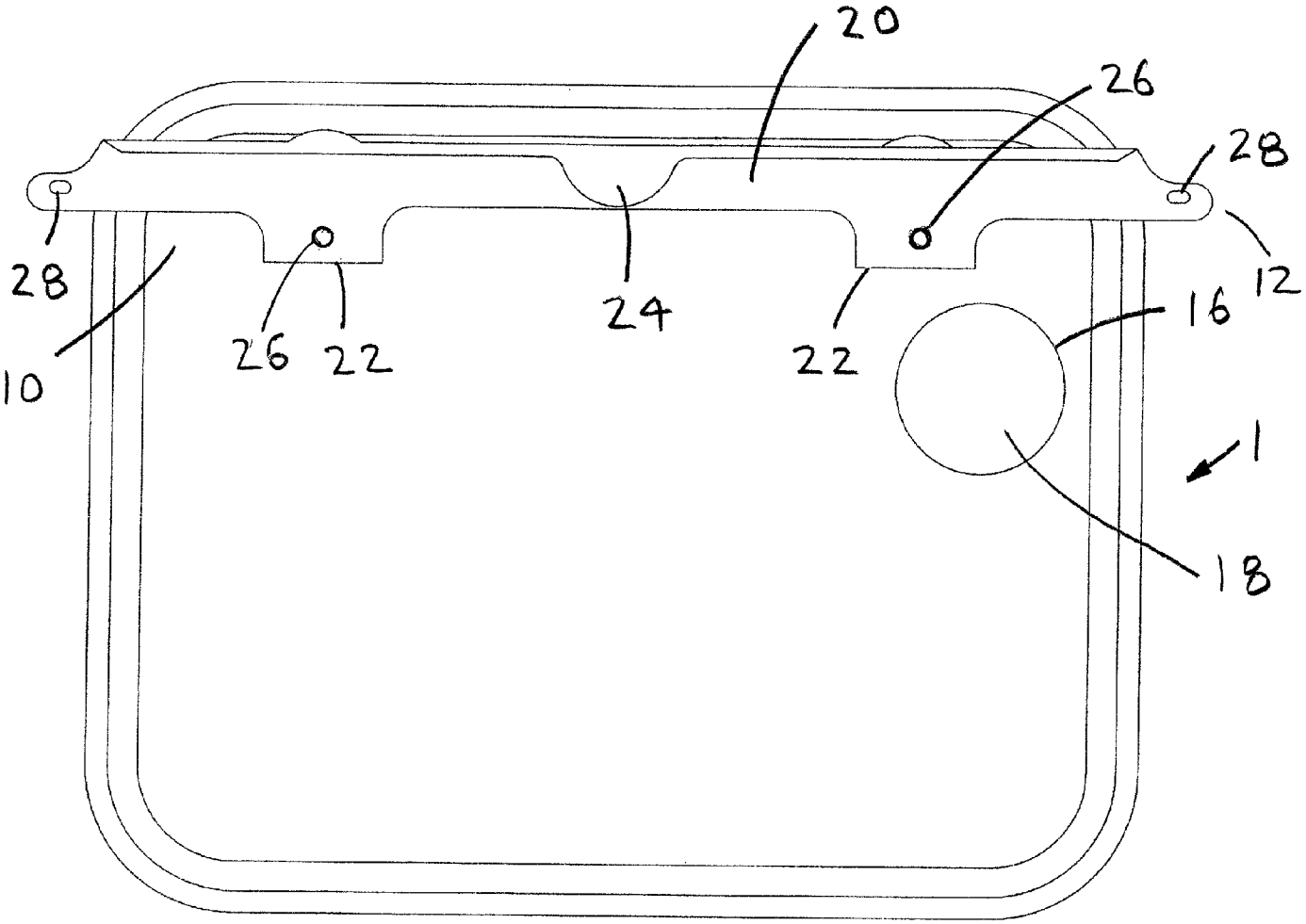
FIG. 4 is a bottom view of a walker attachable tray in accordance with the present invention.
Figure 5:
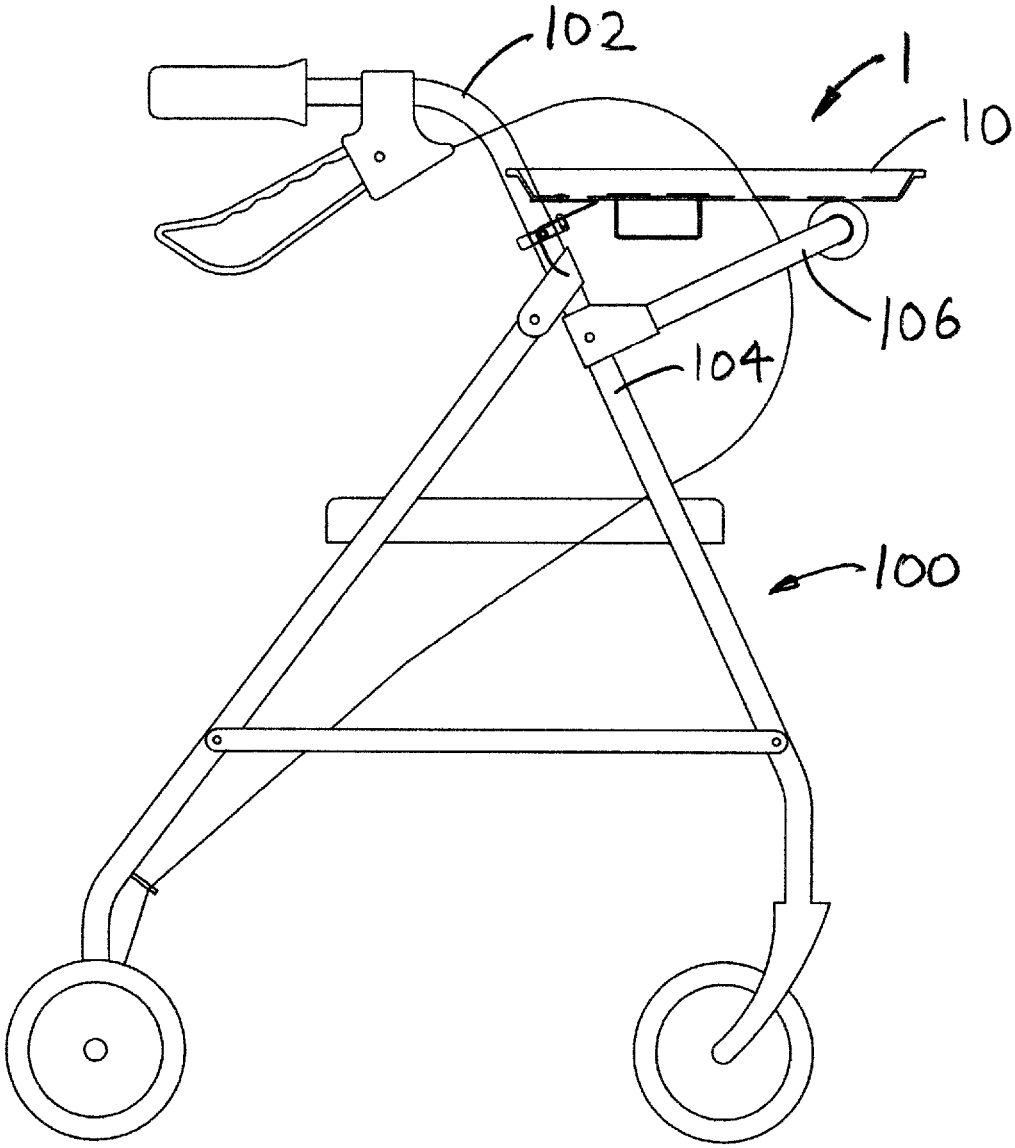
FIG. 5 is a side view of a walker attachable tray attached to a four wheel walker in accordance with the present invention.

With reference now to the drawings, and particularly to FIG. 2, there is shown a top view of a walker attachable tray 1 secured to a four wheel walker 100. With reference to FIGS. 1 and 3-5, the walker attachable tray 1 preferably includes a tray base 10, a mounting bracket 12 and a pair of support rings 14. The tray base 10 may be any suitable plastic or metal tray with a raised peripheral rim 11. A cup holder opening 16 may be formed through the tray base 10 to receive a cup holder 18. The mounting bracket 12 includes a base member 20, at least one mounting flange 22 and a cross bar hook 24. The mounting bracket 12 is attached to a bottom of the tray base 10 adjacent one lengthwise edge thereof with at least two fasteners, such as two rivets 26. The base member 20 is oriented at an acute angle "A" relative to a bottom of the tray base 10 to orient the tray base 10 in a horizontal plane. A pin opening 28 is formed in each end of the base member 20. The at least one mounting flange 22 preferably extends from an edge of the base member and upward. The cross bar hook 24 preferably extends from an opposing edge of the base member 20 and downward.

Figure 6:
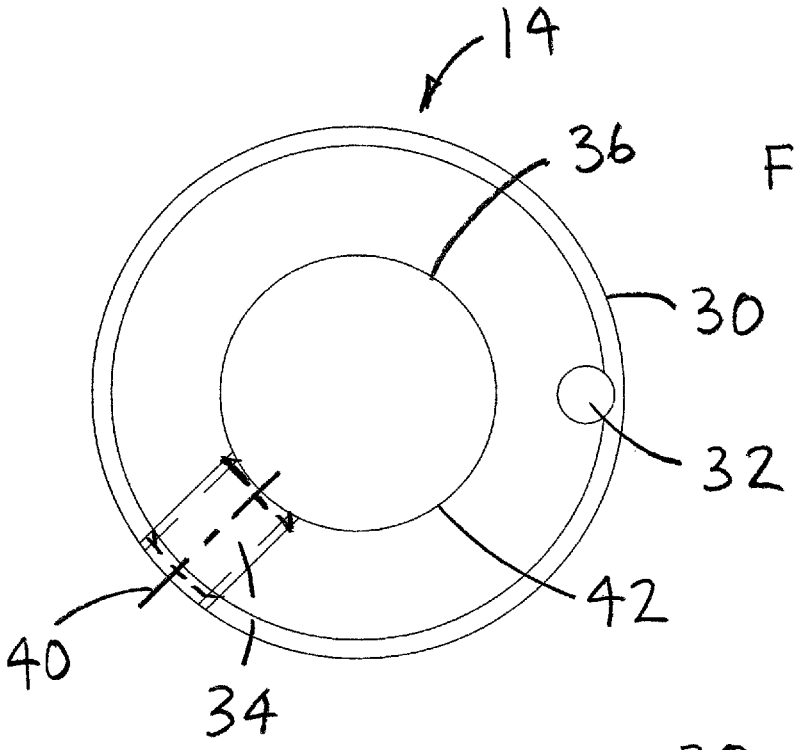
FIG. 6 is an enlarged top view of a support ring of a walker attachable tray in accordance with the present invention.
Figure 7:
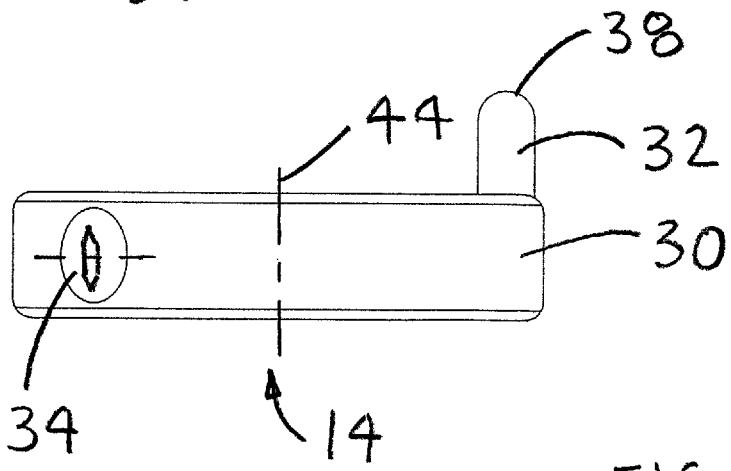
FIG. 7 is an enlarged side view of a support ring of a walker attachable tray in accordance with the present invention.

With reference to FIGS. 6-7, each support ring 14 includes a ring portion 30, a retention pin 32 and a set screw 34. The ring portion 30 includes an inner diameter 36. The retention pin 32 is preferably pressed fitted into a hole formed in the ring portion 30. The retention pin 32 extends upward from the ring portion 30. A rounded end 38 is preferably formed on a top of the retention pin 32 to facilitate insertion into the pin opening 28. An axis 40 of the set screw 34 is perpendicular to an axis 44 of an inner diameter 42 of the ring portion 30.

In use, the walker attachable tray 1 is preferably secured to the four wheel walker 100 in the following manner. A pair of handles 102 are removed from a pair of support tubes 104. The pair of support rings 14 are slipped on to the pair of handles 102. The pair of handles 102 are re-inserted into the pair of support tubes 104. The retention pins 32 are positioned, such that they face inward toward each other. The pair of set screws 34 are tightened against the pair of support tubes 102. The cross bar hook 24 is hooked around a front cross member 106 of the four wheel walker tray 100 and the walker attachable tray 1 is lowered, such that the pair of pin openings 28 are slipped over the pair of retention pins 38. An opposing lengthwise edge of the walker attachable tray 1 is supported by a back rest cross bar 108 of the four wheel walker 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A walker attachable tray comprising:

a tray base;

a mounting bracket includes a base member and a hook member, said hook member extends from said base member, said base member is attached to a bottom of said tray base, a pin opening is formed in each end of said base member; and a pair of support rings, each said support ring includes a retention pin, wherein said pair of support rings are secured to two handles of a walker, said hook member is hooked around a cross member of the walker, said pair of pin openings in said base member are slipped over said pair of retention pins.

2. The walker attachable tray of claim 1, further comprising:

a cup holder opening is formed through said tray base to retain a cup holder.

3. The walker attachable tray of claim 1, wherein:

said mounting bracket is attached to said bottom of said tray base with at least two fasteners.

4. The walker attachable tray of claim 1 wherein:

each support ring includes an inner perimeter and a set screw, wherein said set screw is tightened to secure said support ring to one of the two handles of the walker.

5. The walker attachable tray of claim 1 wherein:

said tray base is fabricated from one of metal and plastic.

6. The walker attachable tray of claim 1 wherein:

said base member is attached to said bottom of said tray base, adjacent a lengthwise edge of said tray base.

7. A walker attachable tray comprising:

a tray base;

a mounting bracket includes a base member, at least one mounting flange and a cross bar hook, said at least one mounting flange extends from said base member, said cross bar hook extends from said base member, a pin opening is formed in each end of said base member, said at least one mounting flange is attached to a bottom of said tray base; and a pair of support rings, each one of said pair of support rings includes a retention pin, wherein said pair of support rings are secured to handles of a walker, said cross hook bar is hooked around a cross member of the walker, said pair of pin openings in said base member are slipped over said pair of retention pins, an opposing lengthwise edge of said tray base rests on a back rest cross bar of the walker.

8. The walker attachable tray of claim 7, further comprising:

a cup holder opening is formed through said tray base to retain a cup holder.

9. The walker attachable tray of claim 7, wherein:

said at least one mounting flange is attached to said bottom of said tray base with at least two fasteners.

10. The walker attachable tray of claim 7 wherein:

each support ring includes an inner perimeter and a set screw, wherein said set screw is tightened to secure said support ring to one of the two handles of the walker.

11. The walker attachable tray of claim 7 wherein:

said tray base is fabricated from one of metal and plastic.

12. The walker attachable tray of claim 7 wherein:

said at least one mounting flange is attached to said bottom of said tray base, adjacent a lengthwise edge of said tray base.

* * * * *